US009816506B2

(12) United States Patent
Rood et al.

(10) Patent No.: US 9,816,506 B2
(45) Date of Patent: Nov. 14, 2017

(54) INTERMEDIATE OIL SEPARATOR FOR IMPROVED PERFORMANCE IN A SCROLL COMPRESSOR

(71) Applicant: Trane International Inc., Piscataway, NJ (US)

(72) Inventors: Jerry Allen Rood, Onalaska, WI (US); Michael Gerard Benco, Onalaska, WI (US); Scott Joseph Smerud, La Crosse, WI (US); John Robert Sauls, La Crosse, WI (US); Rodney Lakowske, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 428 days.

(21) Appl. No.: 14/448,380

(22) Filed: Jul. 31, 2014

(65) Prior Publication Data

US 2015/0037183 A1 Feb. 5, 2015

Related U.S. Application Data

(60) Provisional application No. 61/860,314, filed on Jul. 31, 2013, provisional application No. 61/860,312, filed on Jul. 31, 2013.

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 29/02*** | (2006.01) |
| ***F04C 18/02*** | (2006.01) |
| ***F04C 23/00*** | (2006.01) |

(52) U.S. Cl.

CPC ..... *F04C 29/026* (2013.01); *F04C 18/0207* (2013.01); *F04C 18/0215* (2013.01); *F04C 23/001* (2013.01); *F04C 23/008* (2013.01); *F04C 29/02* (2013.01); *F04C 2240/54* (2013.01)

(58) Field of Classification Search

CPC F04C 18/0215; F04C 18/0207; F04C 23/001; F04C 23/008; F04C 29/02; F04C 29/026; F04C 2240/54; F01C 1/0215

USPC ..... 418/3, 5, 55.1–55.6, 270, DIG. 1

See application file for complete search history.

(56) References Cited

U.S. PATENT DOCUMENTS 4,179,248 A * 12/1979 Shaw ..... F04C 29/02 418/97

4,553,913 A * 11/1985 Morishita ..... F04C 2/025 418/55.5

(Continued)

OTHER PUBLICATIONS

Multistage Definition—Merriam Webster Dictionary—May 3, 2017—https://www.merriam-webster.com/dictionary/multistage.*

*Primary Examiner* — Theresa Trieu

(74) *Attorney, Agent, or Firm* — Hamre, Schumann, Mueller & Larson, P.C.

(57) ABSTRACT

An oil lubrication system for a multi-stage compressor separates oil from a refrigerant at an intermediate pressure following the first stage of compression and then routes the separated oil at the intermediate pressure to the compressor suction cavity bearings at the intermediate pressure, thus avoiding further compression of oil in subsequent stages of compression. The efficiency of the multi-stage compressor can be increased by not raising the pressure of the oil through the subsequent stages of compression.

19 Claims, 3 Drawing Sheets

(56) References Cited

U.S. PATENT DOCUMENTS

Figure 1:
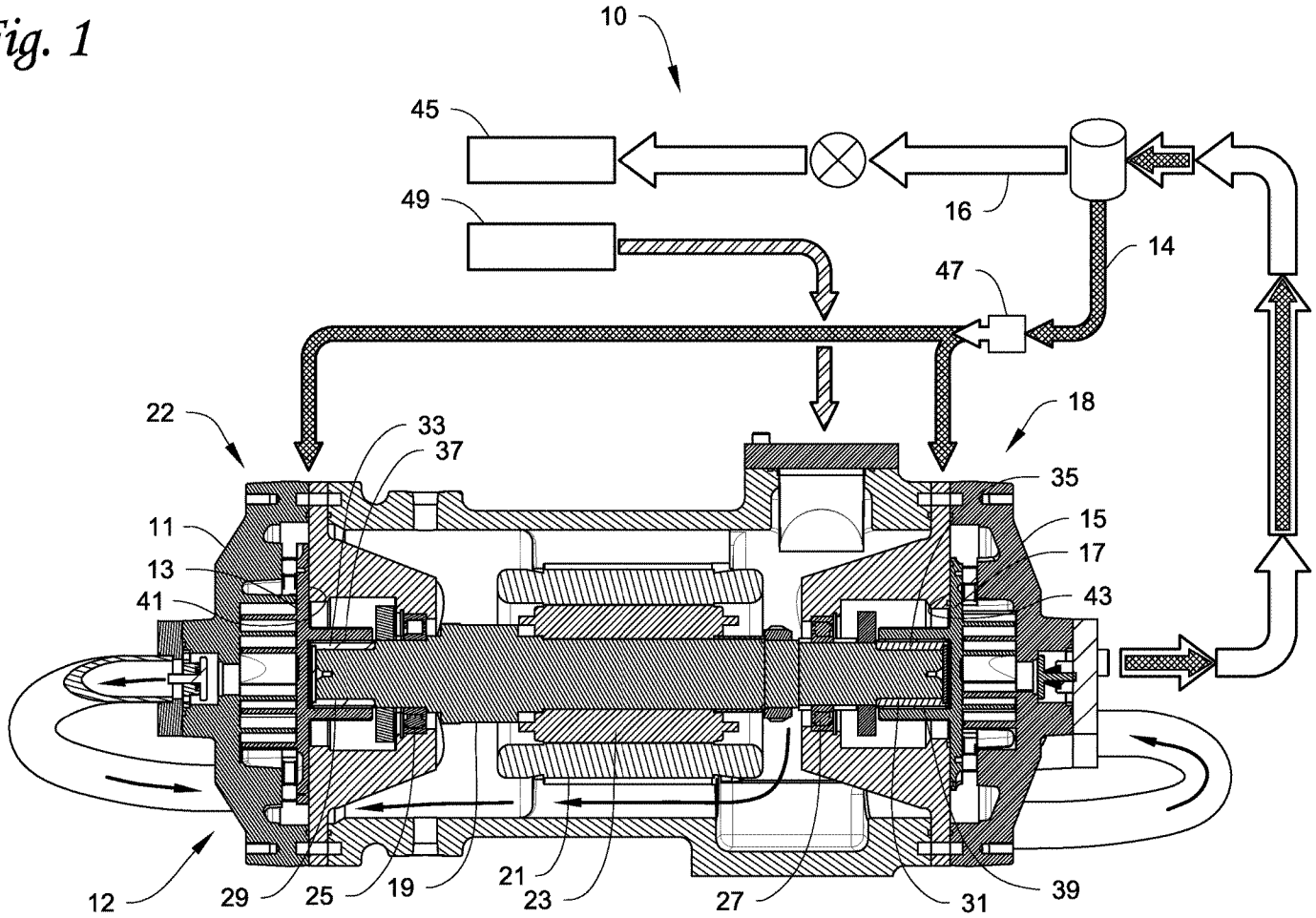

| | | | | |
|---|---|---|---|---|
| 5,112,201 | A * | 5/1992 | Tamura | F04C 29/02 418/55.6 |
| 5,277,564 | A * | 1/1994 | Tamura | F04C 18/0215 418/55.6 |
| 5,624,247 | A | 4/1997 | Nakamura | |
| 5,640,854 | A * | 6/1997 | Fogt | F01C 1/0215 418/55.6 |
| 6,023,935 | A * | 2/2000 | Okazaki | F25B 25/00 62/119 |
| 7,128,540 | B2 | 10/2006 | Tadano et al. | |
| 7,798,791 | B2 | 9/2010 | Byun et al. | |
| RE41,955 | E * | 11/2010 | Rajendran | F04C 18/0215 418/55.1 |
| 7,896,627 | B2 | 3/2011 | Okamoto et al. | |
| 7,914,267 | B2 | 3/2011 | Sato et al. | |
| 7,976,287 | B2 | 7/2011 | Hwang et al. | |
| 8,128,388 | B2 | 3/2012 | Shimoji et al. | |
| 8,172,558 | B2 | 5/2012 | Hasegawa et al. | |
| 8,342,825 | B2 | 1/2013 | Byun et al. | |
| 2003/0150223 | A1 * | 8/2003 | Tang | F04C 18/0215 418/60 |
| 2010/0024467 | A1 | 2/2010 | Sato et al. | |
| 2010/0254835 | A1 | 10/2010 | Kane et al. | |
| 2010/0278674 | A1 | 11/2010 | Byun et al. | |
| 2011/0070115 | A1 | 3/2011 | Takahashi et al. | |
| 2011/0165004 | A1 | 7/2011 | Park et al. | |
| 2013/0017111 | A1 | 1/2013 | Kane et al. | |

* cited by examiner

INTERMEDIATE OIL SEPARATOR FOR IMPROVED PERFORMANCE IN A SCROLL COMPRESSOR

FIELD

The embodiments described herein relate generally to scroll compressor lubrication. More particularly, the embodiments described herein relate to a lubrication system that provides lubrication to the second stage of a two-stage scroll compressor without adversely affecting compressor efficiency.

BACKGROUND

One increasingly popular type of compressor is a scroll compressor. In a scroll compressor, a pair of scroll members orbits relative to each other to compress an entrapped refrigerant.

In typical scroll compressors, a first, stationary, scroll member has a base and a generally spiral wrap extending from its base. A second, orbiting, scroll member has a base and a generally spiral wrap extending from its base. The second, orbiting, scroll member is driven to orbit by a rotating shaft. Some scroll compressors employ an eccentric pin on the rotating shaft that drives the second, orbiting, scroll member.

SUMMARY

Oil at sufficient pressure may be supplied to the bearings in a scroll compressor, such as for example to rolling element, hydrostatic, and/or hydrodynamic bearings of the scroll compressor. In a scroll compressor designed to be a two-stage machine, the second stage bearings are generally supplied by raising the pressure of oil through the second stage of compression, disadvantageously reducing compressor efficiency. Oil could be supplied to both first and second stage bearings by an oil pump attached to the compressor's crankshaft, but the work required to pump the oil disadvantageously becomes an added power loss in the compressor.

In view of the foregoing, there is a need to provide a scheme for lubricating both the first and second stage bearings in a two-stage scroll compressor in a manner that does not adversely affect compressor efficiency.

According to one embodiment, a multi-stage scroll compressor comprises a first stage of compression and a second stage of compression. Refrigerant flows from the first stage of compression to the second stage of compression via an interconnecting pipe. Refrigerant flows from the first stage to the second stage via a first stage discharge port that is connected, either directly or indirectly, for example, by an interconnecting pipe to a second stage suction port. Oil from the bearings which are in the suction cavity of the scroll compressor is entrained in the refrigerant stream that is entering the first stage of compression. The entrained oil is carried with the refrigerant out of the first stage of compression discharge and through the interconnecting pipe toward the second stage of compression. An oil separator that is an integral part of the interconnecting pipe removes oil from the refrigerant stream. The oil removed from the refrigerant stream that is at an intermediate pressure following the first stage of compression, is then routed back to the first and second stage bearings to re-establish the cycle. The refrigerant continues through the interconnecting pipe to the second stage suction. The oil separator after the first stage of compression acts as an oil reservoir at an intermediate pressure. Oil flows from the oil separator to the bearings that are at suction pressure, and so the use of a pump can be avoided.

According to another embodiment, a multi-stage scroll compressor comprises a first stage of compression and a second stage of compression. Oil from the bearings which are in the suction cavity of the scroll compressor is entrained in the refrigerant stream that is entering the first stage of compression. The entrained oil is carried with the refrigerant out of the first stage of compression discharge and into an oil separator. The oil separator removes oil from the refrigerant stream. The oil removed from the refrigerant stream that is at an intermediate pressure following the first stage of compression, is then routed back to the first and second stage suction cavity bearings to re-establish the cycle. The refrigerant is routed through an evaporator to the first and second stage suction inlets. The oil separator after the first stage of compression acts as an oil reservoir at an intermediate pressure. Oil flows from the oil separator to the bearings that are at suction pressure, and so the use of a pump can be avoided.

According to yet another embodiment, a method of providing oil lubrication to a multi-stage compressor comprises fluidically coupling a first, input stage discharge via a refrigerant pipe to a second, output stage suction of a multi-stage compressor comprising a first, input stage of compression and a second, output stage of compression; operating the multi-stage compressor such that a mixture of oil and refrigerant is discharged from the first, input stage discharge; separating the oil from the refrigerant from the discharged mixture via an oil separator; routing the separated oil to suction cavity bearings associated with both the first, input stage of compression and the second, output stage of compression; and routing the separated refrigerant to the second, output stage suction via the refrigerant pipe.

According to still another embodiment, a method of providing oil lubrication to a multi-stage compressor comprises: for a multi-stage compressor comprising a first, input stage and a second, output stage, fluidically coupling a discharge associated with the first, input stage to an intermediate oil separator; operating the multi-stage compressor such that a mixture of oil and refrigerant is discharged from the first, input stage discharge into the intermediate oil separator; separating the oil from the refrigerant from the discharged mixture via the intermediate oil separator; routing the separated oil to suction cavity bearings associated with both the first, input stage and the second, output stage; routing the separated refrigerant to an evaporator; and routing the separated refrigerant processed via the evaporator to refrigerant suction inlets associated with both the first, input stage and the second, output stage.

DRAWINGS

Figure 2:
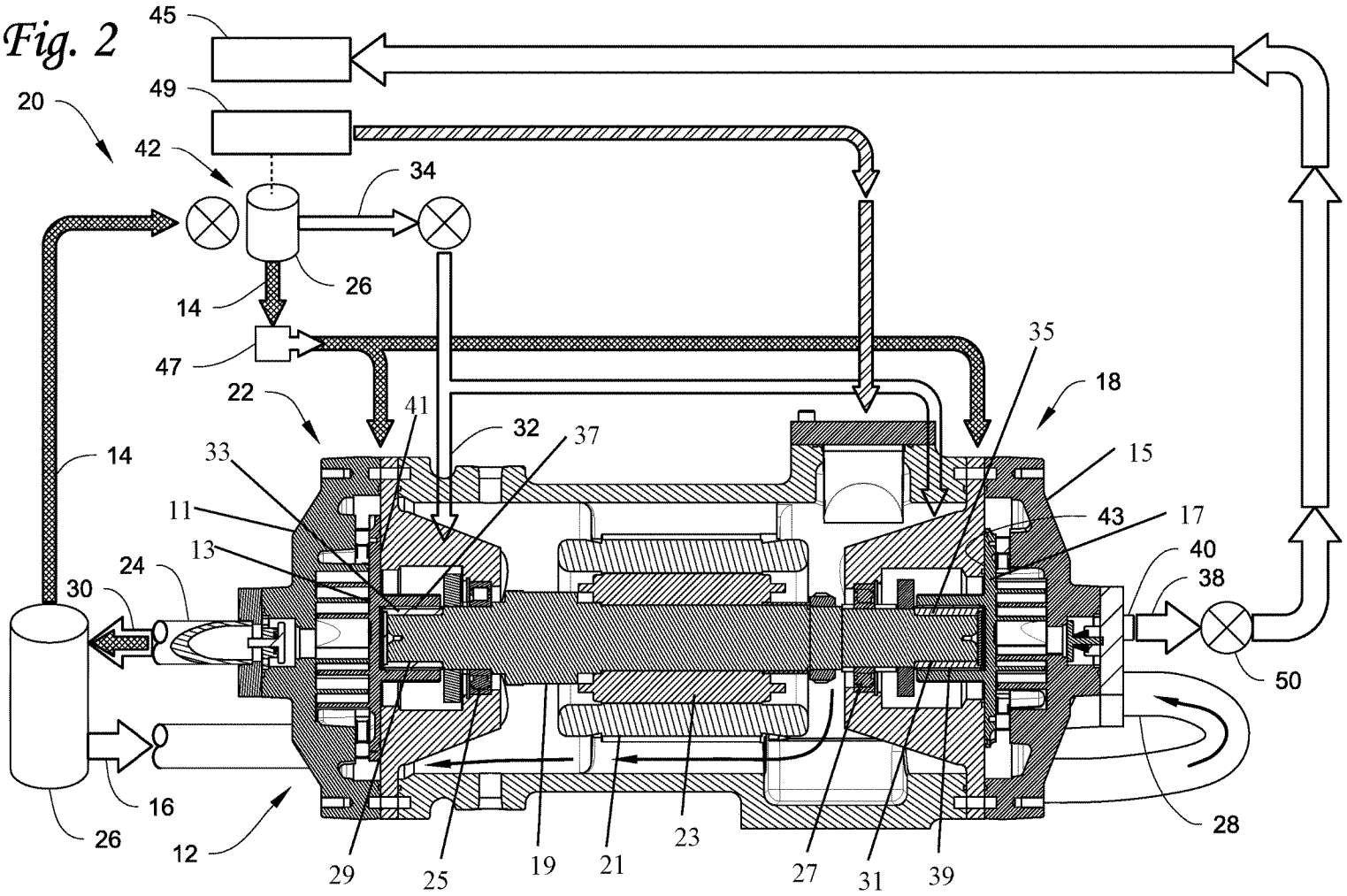

These and other features, aspects, and advantages of the oil lubrication systems and methods will become better understood when the following detailed description is read with reference to the accompanying drawing, wherein:

FIG. 1 is an oil lubrication system flow diagram for a two-stage compressor illustrating separation of oil from a refrigerant at second stage discharge pressure following the compression process and then returning the separated oil to the compressor, according to one embodiment; and FIG. 2 is an oil lubrication system flow diagram for a two-stage compressor illustrating separation of oil from a refrigerant at intermediate pressure following the first stage of compression and then routing the separated oil to the compressor, according to one embodiment.

Figure 3:
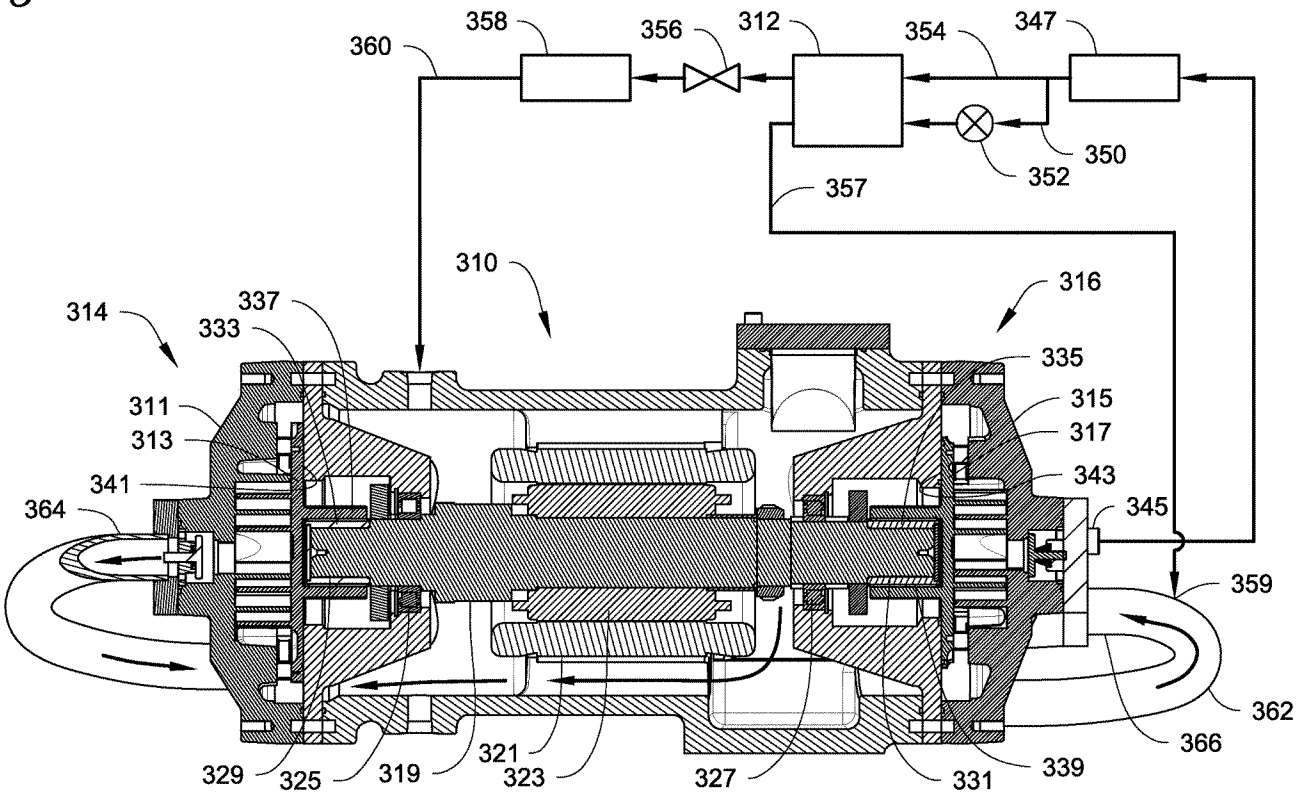

These and other features, aspects, and advantages of a multi-stage large capacity scroll compressor that employs an economizer will become better understood when the following detailed description is read with reference to the accompanying drawing, wherein:

FIG. 3 is a partial perspective view illustrating a two-stage horizontal scroll compressor in fluid communication with an economizer heat exchanger, according to one embodiment.

While the above-identified drawing figures set forth particular embodiments of oil lubrication systems and methods and of systems and methods of the multi-stage large capacity scroll compressor that employs an economizer, other embodiments are also contemplated, as noted in the discussion. In all cases, this disclosure presents illustrated embodiments by way of representation and not limitation. Numerous other modifications and embodiments can be devised by those skilled in the art which fall within the scope and spirit of the principles of the oil lubrication systems and methods and of systems and methods of the multi-stage large capacity scroll compressor that employs an economizer described herein.

DETAILED DESCRIPTION

FIG. 1 is an oil lubrication system flow diagram 10 for a two-stage horizontal compressor, such as scroll compressor 12 illustrating separation of oil 14 from a refrigerant 16 at second stage 18 discharge pressure following the compression process and then returning the separated oil 14 to the compressor 12, according to one embodiment. Although particular embodiments are described herein with respect to horizontal two-stage scroll compressors, it will be appreciated the principles described herein are not so limited, and may just as easily be applied to multi-stage scroll compressors having more than two stages as well as vertical scroll compressors.

Looking again at FIG. 1, the two-stage horizontal scroll compressor 12 is illustrated in cross-sectional side view. Scroll compressor 12 comprises a first, input stage 22 and a second, output stage 18. The first, input stage 22 comprises a fixed, non-orbiting scroll member 11 and an orbiting scroll member 13. The non-orbiting scroll member 11 is positioned in meshing engagement with the orbiting scroll member 13.

The second, output stage 18 also comprises a fixed, non-orbiting scroll member 15 and an orbiting scroll member 17. The second stage non-orbiting scroll member 15 is positioned in meshing engagement with the second stage orbiting scroll member 17.

Scroll compressor 12 further comprises a compressor drive shaft 19 or crankshaft extending between the first, input stage 22 and the second, output stage 18. The crankshaft 19 may be rotatably driven, by way of example and not limitation, via an electric motor comprising windings 21 and a rotor 23 press-fit on the compressor crankshaft 19. The crankshaft 19 may be rotatably journaled within one or more main bearings 25, 27. Each crankshaft main bearing 25, 27 may comprise, by way of example and not limitation, a rolling element bearing having a generally cylindrical portion.

The compressor crankshaft 19 further may comprise a first eccentric drive pin 29 disposed at its first, input stage end. The compressor crankshaft may further comprise a second eccentric drive pin 31 disposed at its second, output stage end. Each eccentric drive pin may be disposed within a bearing sleeve 33, 35 that is placed over a respective eccentric drive pin. The scroll compressor 12 may then operate to provide an orbiting motion of each set of intermeshing scrolls via an orbital radial bearing 37, 39 that is placed over its respective bearing sleeve.

According to one embodiment, the first stage 22 further comprises a conventional hydrodynamic type orbiting scroll thrust bearing 41; while the second stage of compression 18 further comprises a hydrostatic type orbiting scroll thrust bearing 43.

It will be appreciated that the specific bearing types described above are examples only and meant to be non-limiting, as other bearing types may be employed in any of the rolling element, radial, and/or thrust bearings mentioned above.

It can be appreciated that controlling the amount of oil that flows from a compressor into a condenser can generally be implemented in two ways. First, the amount of oil that enters the compression pockets and that is carried by the refrigerant into the condenser can be limited. Second, oil can be separated from the refrigerant after the compression process and subsequently returned to the compressor.

With continued reference to FIG. 1, the oil lubrication system flow diagram 10 for the two-stage horizontal scroll compressor 12 further illustrates separation of oil 14 from a refrigerant 16 at second stage 18 discharge pressure following the compression process and then returning the separated oil 14 to the compressor 12. Because the first and/or second stage bearings may be supplied by raising the pressure of oil through the second stage of compression 18, the compressor efficiency may be disadvantageously reduced in certain operating conditions.

Oil may be used to lubricate a scroll compressor, such as for primarily bearing and involute flank lubrication and secondarily for assisting in the sealing of compression pockets defined by the involute walls. It will be appreciated that the amount of oil that flows from the compressor into the condenser 45, also called oil circulation rate or oil circulation, if minimized, can improve heat exchanger heat transfer efficiency. Further, oil passing through the compression process can use additional power to increase its pressure from suction to discharge pressure, which may be undesirable. Also shown in the flow diagram is an evaporator 49, which is further described below.

Looking now at FIG. 2, and keeping the foregoing principles in mind, an oil lubrication system flow diagram 20 for a horizontal two-stage scroll compressor 12 illustrates separation of oil 14 from a refrigerant 16 at intermediate pressure following the first stage of compression 22 and then routing the separated oil 14 back to the compressor 12, according to one embodiment.

More specifically, in the two stage compressor 12, refrigerant 16 flows from the first stage of compression 22 to the second stage of compression 18 via an interconnecting pipe 24. Oil from the bearings which are in the first stage 22 suction cavity of the two stage compressor 12 is entrained in the refrigerant stream that is entering the first stage of compression 22 and is carried with the refrigerant out of the first stage of compression 22 and through the interconnecting pipe 24 toward the second stage of compression 18.

An oil separator 26 is functionally connected in series with the interconnecting pipe 24. However, it will be appreciated that the oil separator 26 may be located anywhere between the discharge of the first stage of compression 22 and the suction 28 of the second stage of compression 18. In some embodiments, the oil separator 26 may be an integral part of the interconnecting pipe 24, and functions to remove oil from the refrigerant stream 16. The oil 14, which is pressurized at an intermediate pressure when exiting the first stage of compression 22, can then be routed to the suction stage bearings in the first and second stages of compression 22, 18, and the cycle may then repeat itself. Two exemplary locations of an oil separator 26 are shown and not by way of limitation, such as near the first stage discharge or on a relatively high side of the system.

In order to avoid the possibility of foreign particles being continuously circulated to the bearings with the oil 14, in some embodiments a filter 47 may also be provided (see e.g. FIG. 1). Oil filter 47 may be formed, by way of example and not limitation, from a relatively fine mesh stainless steel screen material. Foreign particles can be separated from the oil as it flows downwardly therethrough, so that they are not circulated to the bearing surfaces. It should also be noted that filter 47 may have a substantial surface area and hence can be suitably constructed and/or arranged so as to not restrict oil flow to the suction stage bearings even with an accumulation of foreign particles thereon. In addition to separating foreign particles from the lubricating oil, the filter 47 may also under some circumstances act as a reservoir and aid in inhibiting gaseous refrigerant from being drawn into the suction stage bearings.

The refrigerant 16 continues through the interconnecting pipe 24 to the second stage suction 28. Since the oil separator 26 after the first stage of compression 22 acts as an oil reservoir at intermediate pressure, oil can advantageously flow from the oil separator 26 to the first and second stage bearings that are at suction pressure, and so the use of a pump can be avoided.

The foregoing location for the oil separator 26 following the first stage of compression 22 illustrated in FIG. 2 can advantageously remove the majority of the oil 14 from the refrigerant stream 16 before being compressed in the second stage of compression 18 of the two stage scroll compressor 12. In this way, power requirements can be advantageously reduced for the second stage of compression 18.

The capacity of the compressor 12 for some operating conditions may optionally be reduced by routing flow 30 out of the first stage of compression 22 through the evaporator 49 and back to the first stage suction 32, herein referred to as first stage bypass. First stage bypass is activated when using this location 42 for the oil separator 26 to first separate oil from the refrigerant flow 34 before the refrigerant is bypassed through the evaporator 49 back to suction 32, increasing the likelihood of a continuous flow of oil to the bearings requiring oil lubrication.

It will be appreciated that some oil which may escape from the second stage thrust bearing 43, can be entrained in the second stage refrigerant flow 38 and pass through the second stage discharge 40. As such, oil passing through the second stage discharge 40 will be at the second stage of compression discharge pressure rather than the intermediate pressure described herein. FIG. 2 also shows a backpressure valve 50.

The embodiments described herein can advantageously reduce the oil circulation rate and increase compressor efficiency, while providing an oil supply for the suction stage bearings, such as, without limitation, rolling element bearings, hydrostatic thrust bearings, and/or hydrodynamic thrust bearings. Further, separating the oil at intermediate pressure is adequate to supply oil to the suction stage bearings and to reduce the power input by not compressing oil to the final discharge pressure, as described herein.

In summary explanation, oil separator system embodiments 20 have been described herein with reference to two stages 18, 22 of a scroll compressor 12. These embodiments apply an oil separator 26 as an intermediate, for example between the two stages 18, 22 of the scroll compressor 12 to provide oil at sufficient pressure to supply at least the rolling element bearings, hydrostatic thrust bearings, and/or hydrodynamic thrust bearings for the two stages of compression 18, 22. These embodiments further can reduce the overall energy input by not raising the pressure of the oil through the second stage of compression 18.

Any of aspects 1 to 5 may be combined with any of aspects 6 to 19, and any of aspects 6 to 9 may be combined with any of aspects 10 to 19, and any of aspects 10 to 14 may be combined with any of aspects 15 to 19.

Aspect 1. A multi-stage compressor lubrication system, comprising: a multi-stage compressor, comprising: an input stage comprising: a suction side comprising a suction side bearing oil inlet; and a discharge side; and an output stage comprising: a suction side comprising a suction side bearing oil inlet; and a discharge side, wherein the input stage discharge side is fluidically coupled to the output stage suction side via a refrigerant pipe; and an oil separator fluidically coupled to the input stage discharge side, the output stage suction side, and both the input stage suction side bearing oil inlet and the output stage suction side bearing oil inlet, wherein the oil separator is configured to receive a refrigerant and oil mixture discharged via the input stage discharge side, separate the oil from the refrigerant in the discharged mixture, fluidically transfer the separated refrigerant to the output stage suction side, and fluidically transfer the separated oil to both the input stage suction side bearing oil inlet and the output stage suction side bearing oil inlet.

Aspect 2. The multi-stage compressor lubrication system according to aspect 1, wherein the multi-stage compressor is a two-stage scroll compressor.

Aspect 3. The multi-stage compressor lubrication system according to aspect 1 or 2, wherein the multi-stage compressor is a two-stage scroll compressor comprising a first stage suction side orbiting scroll hydrodynamic thrust bearing.

Aspect 4. The multi-stage compressor lubrication system according to any of aspects 1 to 3, wherein the multi-stage compressor is a two-stage scroll compressor comprising a second stage suction side orbiting scroll hydrostatic thrust bearing.

Aspect 5. The multi-stage compressor lubrication system according to any of aspects 1 to 4, wherein the oil separator is further fluidically coupled to an evaporator, and is further configured to fluidically transfer the separated refrigerant to the evaporator, and fluidically transfer the separated oil to both the input stage suction side bearing oil inlet and the output stage suction side bearing oil inlet.

Aspect 6. A multi-stage compressor lubrication system, comprising: a multi-stage compressor, comprising: an input stage comprising: a suction side comprising a suction side bearing oil inlet; and a discharge side; and an output stage comprising: a suction side comprising a suction side bearing oil inlet; and a discharge side; and an oil separator fluidically coupled to the input stage discharge side, and further fluidically coupled to an evaporator that is fluidically coupled to the input stage suction side and the output stage suction side, and further fluidically coupled to both the input stage suction side bearing oil inlet and the output stage suction side bearing oil inlet, wherein the oil separator is configured to receive a refrigerant and oil mixture discharged via the input stage discharge side, separate the oil from the refrigerant in the discharged mixture, fluidically transfer the separated refrigerant to the evaporator, and fluidically transfer the separated oil to both the input stage suction side bearing oil inlet and the output stage suction side bearing oil inlet.

Aspect 7. The multi-stage compressor lubrication system according to aspect 6, wherein the multi-stage compressor is a two-stage scroll compressor.

Aspect 8. The multi-stage compressor lubrication system according to aspect 6 or 7, wherein the multi-stage compressor is a two-stage scroll compressor comprising a first stage suction side orbiting scroll hydrodynamic thrust bearing.

Aspect 9. The multi-stage compressor lubrication system according to any of aspects 6 to 8, wherein the multi-stage compressor is a two-stage scroll compressor comprising a second stage suction side orbiting scroll hydrostatic thrust bearing.

Aspect 10. A method of providing oil lubrication to a multi-stage compressor, the method comprising: fluidically coupling a first, input stage discharge via a refrigerant pipe to a second, output stage suction of a multi-stage compressor comprising a first, input stage of compression and a second, output stage of compression; operating the multi-stage compressor such that a mixture of oil and refrigerant is discharged from the first, input stage discharge; separating the oil from the refrigerant from the discharged mixture via an oil separator; transferring the separated oil to suction cavity bearings associated with both the first, input stage of compression and the second, output stage of compression; and transferring the separated refrigerant to the second, output stage suction via the refrigerant pipe.

Aspect 11. The method of providing oil lubrication to a multi-stage compressor according to aspect 10, wherein the multi-stage compressor is a two-stage scroll compressor.

Aspect 12. The method of providing oil lubrication to a multi-stage compressor according to aspect 10 or 11, wherein the suction cavity bearings associated with the first, input stage comprise an orbiting scroll hydrodynamic thrust bearing.

Aspect 13. The method of providing oil lubrication to a multi-stage compressor according to any of aspects 10 to 12, wherein the suction cavity bearings associated with the second, output stage comprise an orbiting scroll hydrostatic thrust bearing.

Aspect 14. The method of providing oil lubrication to a multi-stage compressor according to any of aspects 10 to 13, wherein the separated oil is transferred to the suction cavity bearings at an intermediate pressure defined by the first, input stage discharged mixture.

Aspect 15. A method of providing oil lubrication to a multi-stage compressor, the method comprising: for a multi-stage compressor comprising a first, input stage and a second, output stage, fluidically coupling a discharge associated with the first, input stage to an intermediate oil separator; operating the multi-stage compressor such that a mixture of oil and refrigerant is discharged from the first, input stage discharge into the intermediate oil separator; separating the oil from the refrigerant from the discharged mixture via the intermediate oil separator; transferring the separated oil to suction cavity bearings associated with both the first, input stage and the second, output stage; transferring the separated refrigerant to an evaporator; and transferring the separated refrigerant processed via the evaporator to refrigerant suction inlets associated with both the first, input stage and the second, output stage.

Aspect 16. The method of providing oil lubrication to a multi-stage compressor according to aspect 15, wherein the multi-stage compressor is a two-stage scroll compressor.

Aspect 17. The method of providing oil lubrication to a multi-stage compressor according to aspect 15 or 16, wherein the suction cavity bearings associated with the first, input stage comprise an orbiting scroll hydrodynamic thrust bearing.

Aspect 18. The method of providing oil lubrication to a multi-stage compressor according to any of aspects 15 to 17, wherein the suction cavity bearings associated with the second, output stage comprise an orbiting scroll hydrostatic thrust bearing.

Aspect 19. The method of providing oil lubrication to a multi-stage compressor according to any of aspects 15 to 18, wherein the separated oil is transferred to the suction cavity bearings at an intermediate pressure defined by the first, input stage discharged mixture.

Embodiments of a two-stage scroll compressor with an inter-stage economizer are described below, and it will be appreciated that an inter-stage economizer may be employed in any of the above described systems and flow schemes of FIGS. 1 and 2.

The embodiments described herein relate generally to scroll compressors. More particularly, the embodiments described herein relate to a two-stage large capacity scroll compressor that employs an economizer to increase the efficiency of the scroll compressor.

Large refrigeration and cooling units that may use a multiplicity of smaller scroll compressors could instead employ a lesser number of larger scroll compressors. Larger scroll compressors however are generally single stage units that can have large scroll components, which under certain conditions, may result in prohibitively heavy loads on the internal parts of the compressor, such as, for example, bearings, crankshaft, involute walls and the orbiting scroll hub.

In view of the foregoing, there is a need to provide a large capacity scroll compressor that maintains operating loads within the strength requirements of the compressor components such that a lesser number of large capacity scroll compressors can be interchanged with a multiplicity of smaller scroll compressors generally used in large refrigeration and cooling units, such as for example in a chiller of an HVAC system.

According to one embodiment, a scroll compressor comprises a first stage of compression and a second stage of compression. Refrigerant flows from the first stage to the second stage via a first stage discharge port that is connected, either directly or indirectly, for example, by an interconnecting pipe to a second stage suction port. First and second stage suction cavity volumes are defined such that an economizer heat exchanger based on the first and second stage suction cavity volumes may receive tapped refrigerant downstream from the scroll compressor and return the tapped refrigerant to the scroll compressor at an intermediate pressure via the interconnecting pipe.

According to another embodiment, a cooling system comprises a two-stage scroll compressor. The two-stage scroll compressor comprises an input stage comprising a suction port and a discharge port. The two-stage scroll compressor further comprises an output stage comprising a suction port and a discharge port, wherein the input stage discharge port is fluidically coupled directly to the output stage suction port via a refrigerant pipe. The cooling system also comprises an economizer fluidically coupled to the refrigerant pipe, wherein the economizer is configured to receive a refrigerant discharged via the output stage discharge port and fluidically transfer a portion of the received refrigerant via a return injection line to the refrigerant pipe at an intermediate pressure less than the second stage discharge pressure.

According to yet another embodiment, a cooling system comprises a two-stage scroll compressor comprising a first stage of compression discharge port and a second stage of compression suction port. The cooling system further comprises a refrigerant pipe fluidically coupling the first stage of compression discharge port directly to the second stage of compression suction port. The first stage of compression further comprises a suction cavity volume and the second stage of compression further comprises a suction cavity volume. The first stage suction cavity volume and the second stage suction cavity volume together define whether an economizer heat exchanger is to be implemented for the two-stage scroll compressor to meet cooling system cooling requirements, which may under certain circumstances be predetermined.

According to still another embodiment, a method of cooling, for example a predetermined space and/or a process fluid comprises, for a two-stage scroll compressor, fluidically coupling a first stage discharge port directly to a second stage suction port via a refrigerant pipe, conduit or tube. The two-stage scroll compressor is then operated to discharge a pressurized refrigerant. A first portion of the discharged refrigerant is expanded and then processed through an economizer heat exchanger. The first portion of the discharged refrigerant processed through the economizer heat exchanger is then returned to the two-stage scroll compressor at an intermediate pressure less than the discharged pressure.

FIG. 3 is a partial perspective view illustrating a two-stage horizontal scroll compressor 310 in fluid communication with an economizer heat exchanger 312, according to one embodiment. Although particular embodiments are described herein with respect to horizontal two-stage scroll compressors, it will be appreciated the principles described herein are not so limited, and may just as easily be applied to multi-stage scroll compressors having more than two stages as well as vertical scroll compressors.

Looking again at FIG. 3, the two-stage horizontal scroll compressor 310 is illustrated in perspective cutaway view. Scroll compressor 310 comprises a first, input stage 314 and a second, output stage 316. The first, input stage 314 comprises a fixed, non-orbiting scroll member 311 and an orbiting scroll member 313. The non-orbiting scroll member 311 is positioned in meshing engagement with the orbiting scroll member 313.

The second, output stage 316 also comprises a fixed, non-orbiting scroll member 315 and an orbiting scroll member 317. The second stage non-orbiting scroll member 315 is positioned in meshing engagement with the second stage orbiting scroll member 317.

Scroll compressor 310 further comprises a compressor drive shaft 319 or crankshaft extending between the first, input stage 314 and the second, output stage 316. The crankshaft 319 may be rotatably driven, by way of example and not limitation, via an electric motor comprising windings 321 and a rotor 323 press-fit on the compressor crankshaft 319. The crankshaft 319 may be rotatably journaled within one or more main bearings 325, 327. Each crankshaft main bearing 325, 327 may comprise, by way of example and not limitation, a rolling element bearing having a generally cylindrical portion.

The compressor crankshaft 319 further may comprise a first eccentric drive pin 329 disposed at its first, input stage end. The compressor crankshaft may further comprise a second eccentric drive pin 331 disposed at its second, output stage end. Each eccentric drive pin may be disposed within a bearing sleeve 333, 335 that is placed over a respective eccentric drive pin. The scroll compressor 310 may then operate to provide an orbiting motion of each set of intermeshing scrolls via an orbital radial bearing 337, 339 that is placed over its respective bearing sleeve.

According to one embodiment, the first stage 314 further comprises a conventional hydrodynamic type orbiting scroll thrust bearing 341; while the second stage of compression 316 further comprises a hydrostatic type orbiting scroll thrust bearing 343. It will be appreciated that at least one stage, either first or second, may comprise a hydrostatic type orbiting scroll thrust bearing based upon the particular application.

It will be appreciated that the specific bearing types described above are examples only and meant to be non-limiting, as other bearing types may be employed in any of the rolling element, radial, and/or thrust bearings mentioned above.

With continued reference to FIG. 3, refrigerant compressed by the scroll compressor 310 is discharged from the discharge port 345, and then to a condenser 347. Downstream of the condenser 347 in some embodiments is an economizer heat exchanger 312. The economizer heat exchanger 312 may be a conventional heat exchanger or may of a flash tank type. The economizer heat exchanger 312 receives a tapped refrigerant from a tap line 350 passing through an economizer expansion device 352, and a main refrigerant from a liquid line 354. Generally the flow of tapped refrigerant from tap line 350 can be in counterflow arrangement with the flow of main refrigerant in liquid line 354 as they pass through the economizer heat exchanger 312. Where a flash tank type economizer is employed as the economizer heat exchanger 312, refrigerant exiting condenser flows through line 350 to expansion valve 352. No refrigerant flows through line 354. Liquid refrigerant exits the economizer heat exchanger 312, e.g. flash tank, and passes through expansion valve 356. Refrigerant gas exits the economizer heat exchanger 312 through line 357 and enters an intermediate compression point or area 359 or injection port (or plurality of ports) in compressor 310.

The tapped refrigerant in the tap line 350 subcools the refrigerant in the liquid line 354, such that after passing through a main expansion device 356, it will have a higher cooling potential prior to entering an evaporator 358. From the evaporator 358, the refrigerant returns to a suction line 360 leading back to the compressor 310. The tapped refrigerant from the tap line 350 passes through the return injection line 357 to enter an intermediate compression point or area 359 or injection port (or plurality of ports) in the compressor 310.

According to one embodiment, the intermediate compression point 359 is a predetermined location along a refrigerant line 362 that fluidically couples a first stage discharge port 364 to a second stage suction port 366. The term refrigerant line as used herein shall be understood to mean refrigerant pipe, refrigerant conduit, refrigerant tube, and so on.

It will be appreciated that unit capacity can be a function of refrigerant mass flow through an evaporator, and that the refrigerant gas mass flow defines the suction volume required for a particular compressor. The size of a single stage scroll set in some cases can be a function of the suction volume and the required volume ratio between suction volume and discharge volume.

The embodiments described herein separate the compression process into two stages 314, 316. By separating the compression process into two stages, the size of the two scroll sets 311, 313 and 315, 317 can be defined so that the operating loads can be within the strength requirements of the compressor components, as stated herein. Further, the suction cavity volumes of both the first and second stage 314, 316 can be defined so that an economizer 312 may or may not be added to the compressor unit 310. It will be appreciated that adding an economizer 312 can reduce the amount of refrigerant gas that has to pass through the first stage compression process for a given capacity. This structure can advantageously result in lower power required for a given capacity and can ultimately yield a higher efficiency.

It will also be appreciated that large refrigeration and cooling units that normally use a multiplicity of small single stage scroll compressors can be reconfigured to use a lesser number of larger scroll compressors using the principles described herein. According to one embodiment, each of the lesser number of scroll compressors can in some cases employ a larger two-stage scroll compressor that separates the compression process into two stages allowing the size of each scroll set to be individually designed so that the operating loads are within the strength requirements of the compressor components, including without limitation, bearings, crankshaft, involute walls and the orbiting scroll hub. The resultant large refrigeration and cooling unit may be further refined by adding an economizer to at least one two-stage compressor unit to provide a more efficient refrigeration and cooling unit that can require less power for a given capacity.

Any of aspects 1 to 5 may be combined with any of aspects 6 to 15, and any of aspects 6 to 11 may be combined with any of aspects 12 to 15, and any of aspects 12 and 13 may be combined with any of aspects 14 and 15.

Aspect 1. A cooling system, comprising: a two-stage scroll compressor, comprising: an input stage comprising: a suction port; and a discharge port; and an output stage comprising: a suction port; and a discharge port, wherein the input stage discharge port is fluidically coupled to the output stage suction port via a refrigerant line; and an economizer fluidically coupled to the refrigerant line, wherein the economizer is configured to receive a refrigerant discharged via the output stage discharge port and fluidically transfer a portion of the received refrigerant via a return injection line to the refrigerant line at an intermediate pressure less than the second stage discharge pressure.

Aspect 2. The cooling system according to aspect 1, further comprising: a condenser fluidically coupled to the output stage discharge port; a main refrigerant line fluidically coupling the condenser to the economizer; and a tapped refrigerant line fluidically coupling the condenser to the economizer, wherein the portion of refrigerant transferred to the refrigerant pipe at intermediate pressure is further transferred via the tapped refrigerant line.

Aspect 3. The cooling system according to aspect 1 or 2, wherein the two-stage scroll compressor is a horizontal two-stage scroll compressor.

Aspect 4. The cooling system according to any of aspects 1 to 3, wherein at least one stage comprises an orbiting scroll hydrostatic thrust bearing.

Aspect 5. The cooling system according to any of aspects 1 to 4, wherein the first stage and second stage each comprises a respective suction cavity volume such that together the suction cavity volumes are sized to define whether an economizer heat exchanger is required for the two-stage scroll compressor to meet cooling system cooling requirements.

Aspect 6. A cooling system, comprising: a two-stage scroll compressor comprising a first stage of compression discharge port and a second stage of compression suction port; and a refrigerant line fluidically coupling the first stage of compression discharge port to the second stage of compression suction port.

Aspect 7. The cooling system according to aspect 6, wherein the first stage of compression comprises a suction cavity volume and the second stage of compression comprises a suction cavity volume, and further wherein the first stage suction cavity volume and the second stage suction cavity volume together are sized to define whether an economizer heat exchanger is required for the two-stage scroll compressor to meet cooling system cooling requirements.

Aspect 8. The cooling system according to aspect 6 or 7, further comprising an economizer fluidically coupled to the two-stage scroll compressor, wherein the economizer is configured to receive a refrigerant discharged via the scroll compressor and to fluidically transfer a portion of the received refrigerant via a return injection line to the two-stage scroll compressor at an intermediate pressure less than the two-stage scroll compressor discharge pressure.

Aspect 9. The cooling system according to any of aspects 6 to 8, further comprising an economizer fluidically coupled to a discharge port associated with the second stage of compression, and further wherein the economizer is configured to receive a refrigerant discharged via the discharge port and to fluidically transfer a portion of the received refrigerant via a return injection line to the refrigerant line at an intermediate pressure less than the second stage scroll compressor discharge pressure.

Aspect 10. The cooling system according to any of aspects 6 to 9, wherein the two-stage scroll compressor is a horizontal two-stage scroll compressor.

Aspect 11. The cooling system according to any of aspects 6 to 10, wherein at least one stage comprises an orbiting scroll hydrostatic thrust bearing.

Aspect 12. A method of cooling a predetermined space, the method comprising: operating a two-stage scroll compressor and discharging a pressurized refrigerant therefrom in response thereto; expanding a first portion of the discharged refrigerant via an economizer heat exchanger; and returning the first portion of the discharged refrigerant to a refrigerant line fluidically coupling a first stage discharge port to a second stage suction port for the two-stage scroll compressor, such that the first portion of the discharged refrigerant is returned to the two-stage scroll compressor at an intermediate pressure less than the discharged pressure.

Aspect 13. The method according to aspect 12, wherein the first portion of the discharged refrigerant is returned to the two-stage scroll compressor via a return injection line fluidically coupled directly to the refrigerant line.

Aspect 14. A method of cooling a predetermined space, the method comprising: operating a two-stage scroll compressor and discharging a pressurized refrigerant therefrom in response thereto; expanding the discharged refrigerant via a flash tank economizer; and returning the first portion of the discharged refrigerant to a refrigerant line fluidically coupling a first stage discharge port to a second stage suction port for the two-stage scroll compressor, such that the first portion of the discharged refrigerant is returned to the two-stage scroll compressor at an intermediate pressure less than the discharged pressure; and expanding the second portion of the discharged refrigerant to an evaporator; and returning the second portion of the discharged refrigerant to an evaporator fluidically coupling a first stage suction port for the two-stage scroll compressor, such that the second portion of the discharged refrigerant is returned to the two-stage scroll compressor at a suction pressure less than the intermediate pressure.

Aspect 15. The method according to aspect 14, wherein the first portion of the discharged refrigerant is returned to the two-stage scroll compressor via a return injection line fluidically coupled directly to the refrigerant line.

A scroll compressor includes a first stage of compression and a second stage of compression. Refrigerant flows from the first stage to the second stage via a first stage discharge port that is connected by an interconnecting refrigerant line to a second stage suction port. First and second stage suction cavity volumes are defined such that an economizer heat exchanger based on the first and second stage suction cavity volumes may receive tapped refrigerant downstream from the scroll compressor and return the tapped refrigerant to the scroll compressor at an intermediate pressure via the interconnecting refrigerant line.

While the embodiments have been described in terms of various specific embodiments, those skilled in the art will recognize that the embodiments can be practiced with modification within the spirit and scope of the claims.

What is claimed is:

1. A lubrication system for a multi-stage compressor, comprising:

a multi-stage compressor, comprising:

an input stage, an output stage, and a crankshaft, the input and output stages being disposed on the crankshaft, the input stage, comprising:

a suction comprising a suction bearing oil inlet; and a discharge; and the output stage, comprising:

a suction comprising a suction bearing oil inlet; and a discharge, wherein the input stage discharge is fluidically coupled to the output stage suction via an interconnecting pipe such that refrigerant flows from the input stage to the output stage; and an oil separator fluidically coupled to the input stage discharge, the output stage suction, and both the input stage suction bearing oil inlet and the output stage suction bearing oil inlet, wherein the oil separator is configured to receive a refrigerant and oil mixture discharged via the input stage discharge, separate the oil from the refrigerant in the discharged mixture, fluidically transfer the separated refrigerant to the output stage suction, and fluidically transfer the separated oil to both the input stage suction bearing oil inlet and the output stage suction bearing oil inlet.

2. The lubrication system according to claim 1, wherein the multi-stage compressor is a two-stage scroll compressor.

3. The lubrication system according to claim 1, wherein the multi-stage compressor is a two-stage scroll compressor comprising an input stage suction orbiting scroll hydrodynamic thrust bearing.

4. The lubrication system according to claim 1, wherein the multi-stage compressor is a two-stage scroll compressor comprising an output stage suction orbiting scroll hydrostatic thrust bearing.

5. The lubrication system according to claim 1, wherein the oil separator is further fluidically coupled to an evaporator, and is further configured to fluidically transfer the separated refrigerant to the evaporator, and fluidically transfer the separated oil to both the input stage suction bearing oil inlet and the output stage suction bearing oil inlet.

6. A multi-stage compressor lubrication system, comprising:

a multi-stage compressor, comprising:

an input stage, an output stage, and a crankshaft, the input and output stages being disposed on the crankshaft, the input stage comprising:

a suction comprising a suction bearing oil inlet; and a discharge; and the output stage comprising:

a suction comprising a suction bearing oil inlet; and a discharge, wherein the input stage discharge is fluidically connected to the output stage suction via an interconnecting pipe; and an oil separator fluidically coupled to the input stage discharge, and further fluidically coupled to an evaporator and fluidically coupled to the input stage suction and the output stage suction, and further fluidically coupled to both the input stage suction bearing oil inlet and the output stage suction bearing oil inlet, wherein the oil separator is configured to receive a refrigerant and oil mixture discharged via the input stage discharge, separate the oil from the refrigerant in the discharged mixture, fluidically transfer the separated refrigerant to the evaporator, and fluidically transfer the separated oil to both the input stage suction bearing oil inlet and the output stage suction bearing oil inlet.

7. The multi-stage compressor lubrication system according to claim 6, wherein the multi-stage compressor is a two-stage scroll compressor.

8. The multi-stage compressor lubrication system according to claim 6, wherein the multi-stage compressor is a two-stage scroll compressor comprising an input stage suction orbiting scroll hydrodynamic thrust bearing.

9. The multi-stage compressor lubrication system according to claim 6, wherein the multi-stage compressor is a two-stage scroll compressor comprising an output stage suction orbiting scroll hydrostatic thrust bearing.

10. A method of providing oil lubrication to a multi-stage compressor, the method comprising:

fluidically coupling a first, input stage discharge via an interconnecting pipe to a second, output stage suction of a multi-stage compressor, the multi-stage compressor comprising a first, input stage of compression, a second, output stage of compression, and an oil separator, wherein the first, input stage discharge is fluidically coupled to the second, output stage suction via the interconnecting pipe such that refrigerant flows from the first, input stage of compression to the second, output stage of compression, the oil separator being fluidically coupled to the first, input stage discharge and the second, output stage suction, and the oil separator being fluidically connected to a first, input stage suction bearing oil inlet and a second, output stage suction bearing oil inlet;

operating the multi-stage compressor such that a mixture of oil and refrigerant is discharged from the first, input stage discharge;

separating the oil from the refrigerant from the discharged mixture via the oil separator;

transferring the separated oil to suction cavity bearings associated with both the first, input stage of compression and the second, output stage of compression via the first, input stage suction bearing oil inlet and the second, output stage suction bearing oil inlet; and transferring the separated refrigerant to the second, output stage suction via the interconnecting pipe.

11. The method of providing oil lubrication to a multi-stage compressor according to claim 10, wherein the multi-stage compressor is a two-stage scroll compressor.

12. The method of providing oil lubrication to a multi-stage compressor according to claim 10, wherein the suction cavity bearings associated with the first, input stage comprise an orbiting scroll hydrodynamic thrust bearing.

13. The method of providing oil lubrication to a multi-stage compressor according to claim 10, wherein the suction cavity bearings associated with the second, output stage comprise an orbiting scroll hydrostatic thrust bearing.

14. The method of providing oil lubrication to a multi-stage compressor according to claim 10, wherein the separated oil is transferred to the suction cavity bearings at an intermediate pressure defined by the first, input stage discharged mixture.

15. A method of providing oil lubrication to a multi-stage compressor, the method comprising:

for a multi-stage compressor comprising a first, input stage and a second, output stage, fluidically coupling a discharge associated with the first, input stage to an intermediate oil separator, wherein the discharge associated with the first, input stage is fluidically coupled to a second, output stage suction via an interconnecting pipe such that refrigerant flows from the first, input stage to the second, output stage, the intermediate oil separator being fluidically coupled to the discharge associated with the first, input stage and the second, output stage suction via an evaporator, and the intermediate oil separator being fluidically connected to a first, input stage suction bearing oil inlet and a second, output stage suction bearing oil inlet;

operating the multi-stage compressor such that a mixture of oil and refrigerant is discharged from the discharge associated with the first, input stage discharge into the intermediate oil separator;

separating the oil from the refrigerant from the discharged mixture via the intermediate oil separator;

transferring the separated oil to suction cavity bearings associated with both the first, input stage and the second, output stage;

transferring the separated refrigerant to the evaporator; and transferring the separated refrigerant processed via the evaporator to refrigerant suction inlets associated with both the first, input stage and the second, output stage.

16. The method of providing oil lubrication to a multi-stage compressor according to claim 15, wherein the multi-stage compressor is a two-stage scroll compressor.

17. The method of providing oil lubrication to a multi-stage compressor according to claim 15, wherein the suction cavity bearings associated with the first, input stage comprise an orbiting scroll hydrodynamic thrust bearing.

18. The method of providing oil lubrication to a multi-stage compressor according to claim 15, wherein the suction cavity bearings associated with the second, output stage comprise an orbiting scroll hydrostatic thrust bearing.

19. The method of providing oil lubrication to a multi-stage compressor according to claim 15, wherein the separated oil is transferred to the suction cavity bearings at an intermediate pressure defined by the first, input stage discharged mixture.

* * * * *